US007883449B2

(12) United States Patent
Wan

(10) Patent No.: US 7,883,449 B2
(45) Date of Patent: Feb. 8, 2011

(54) AUXILIARY SUPPORTING DEVICE OF A BICYCLE

(76) Inventor: Kuo-Hui Wan, 13F.-2, No. 91, Sihwei Rd., Hsinchu City 300 (TW)

( * ) Notice: Subject to any disclaimer, the term of this patent is extended or adjusted under 35 U.S.C. 154(b) by 190 days.

(21) Appl. No.: 11/412,798

(22) Filed: Apr. 28, 2006

(65) Prior Publication Data

US 2007/0202998 A1 Aug. 30, 2007

(30) Foreign Application Priority Data

Feb. 27, 2006 (TW) ..... 95106566 A

(51) Int. Cl.
*A63B 22/06* (2006.01)

(52) U.S. Cl. ..... 482/57; 482/62

(58) Field of Classification Search ..... 482/51, 482/54, 57–63; 434/61, 247; 601/34, 35, 601/36

See application file for complete search history.

(56) References Cited

U.S. PATENT DOCUMENTS 593,105 A * 11/1897 Kingsbury ..... 482/61
2,498,047 A * 2/1950 Myers ..... 601/93
3,905,597 A * 9/1975 Tabb ..... 482/61
4,082,265 A * 4/1978 Berkes ..... 482/61
4,415,152 A * 11/1983 Smith ..... 482/61
4,580,983 A * 4/1986 Cassini et al. ..... 482/61
4,750,737 A * 6/1988 Smith ..... 482/61
4,802,666 A * 2/1989 Rodriqguez ..... 482/61
4,925,183 A * 5/1990 Kim ..... 482/61
4,932,651 A * 6/1990 Defaux ..... 482/61
4,958,832 A * 9/1990 Kim ..... 482/61
5,042,795 A * 8/1991 Bursik ..... 482/61
5,662,559 A * 9/1997 Vasquez ..... 482/61
6,004,243 A * 12/1999 Ewert ..... 482/8
6,530,864 B1 * 3/2003 Parks ..... 482/4
6,857,992 B1 * 2/2005 Kolda et al. ..... 482/61
7,326,151 B2 * 2/2008 Peterson et al. ..... 482/61
7,520,842 B2 * 4/2009 Comair et al. ..... 482/61
2004/0053751 A1 * 3/2004 Pizolato ..... 482/61
2005/0209064 A1 * 9/2005 Peterson et al. ..... 482/61

* cited by examiner

*Primary Examiner*—Loan Thanh
*Assistant Examiner*—Tam Nguyen

(57) ABSTRACT

An auxiliary supporting device is designed for supporting and fixing a bicycle. When a user rides a bicycle which is set up on this supporting device, the bicycle will neither move forward nor fall down if the user applies the skill of riding bicycle. This device can be used to train a rider for better bicycle controllability or to let user exercise at a fixed location.

5 Claims, 10 Drawing Sheets

AUXILIARY SUPPORTING DEVICE OF A BICYCLE

BACKGROUND OF THE INVENTION

1. Field of the Invention

The present invention relates to an auxiliary supporting device of a bicycle and, more particularly, to an auxiliary supporting device of a bicycle for exercise.

2. Description of Related Art

With the progress of science and technology, people become busier and have less time to go out exercising. Moreover, because high buildings stand in great numbers in cities, there are less and less places where people can exercise.

Therefore, many kinds of exercise equipments have sprung up in the market such as exercise bicycles, treadmills, and so on. People can use these equipments to exercise indoors.

In the disclosure of U.S. Pat. No. 6,612,970, an adjustable stationary exercise bicycle is proposed. As shown in FIG. 1, a bicycle 10 comprises a seat 102, handlebars 104, two connected pedals 106 and a wheel 108. All the above components are disposed on a lower frame 110. This bicycle, however, cannot swing along an imaginary axis direction of the wheel contact surface.

In the disclosure of U.S. Pat. No. 6,736,761, a stationary bicycle resistance generator is proposed. As shown in FIG. 2, a stationary bicycle resistance generator 20 comprises two struts 202 and two retaining sleeves 204. The rear wheel axle of a bicycle is fixed on the retaining sleeves 204. The bicycle, however, cannot swing left or right on the stationary bicycle resistance generator 20.

In the disclosure of U.S. Pat. No. 6,126,577, an exercise stationary bicycle is proposed. As shown in FIG. 3, a bicycle 30 comprises a seat 302, handlebars 304, two connected pedals 306 and a wheel 308. All the above components are disposed on a lower frame 310. This frame 310 is supported and balanced on a base 314 by a left and a right hydraulic cylinders 312. Although this bicycle 30 can swing left or right, it is not based on the balance principle of bicycle (i.e., a bicycle is balanced by the moment of inertia generated through rotation of wheels), but makes use of the supporting and balancing function of the two hydraulic cylinders 312.

The present invention aims to propose an auxiliary supporting device of a bicycle to solve the above problems in the prior art.

SUMMARY OF THE INVENTION

An object of the present invention is to propose an auxiliary supporting device of a bicycle to accomplish the exercising effect.

Another object of the present invention is to propose an auxiliary supporting device of a bicycle, in which the front and rear wheels of the bicycle rotate synchronously so that a user can simulate the exercise of riding a bicycle at a fixed location to accomplish the exercising effect.

Yet another object of the present invention is to propose an auxiliary supporting device of a bicycle, in which the handlebars of the bicycle can be turned left or right so that a user can apply the skill of riding bicycle.

Still yet another object of the present invention is to propose an auxiliary supporting device of a bicycle, in which the bicycle can swing along an imaginary axis (embodied with a main rotating shaft) direction of the wheel contact surface to train a user his sense of balance.

To achieve the above objects, the present invention proposes an auxiliary supporting device of a bicycle, which comprises a base, two rolling elements and a supporting element. The base is connected with a main rotating shaft having a protruding part, which is engaged with a wheel axle of a rear wheel of a bicycle. The two rolling elements are disposed on the base and located below the protruding part so that partial wheel surface of the rear wheel is located on the rolling element. The supporting element is disposed above the main rotating shaft. The supporting element is engaged with a front wheel of the bicycle. The supporting element includes a rotating element with a rolling element. The front wheel is located on the rolling element. A rotating guide wire is used to connect the rear wheel rolling elements and the front wheel rolling element. When a user sits on the bicycle and moves the pedals, the rear wheel leads the rolling element to roll and further drives front wheel rotate via the rotating guide wire and front wheel rolling element, thereby accomplishing synchronous rotation of the front and rear wheels.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
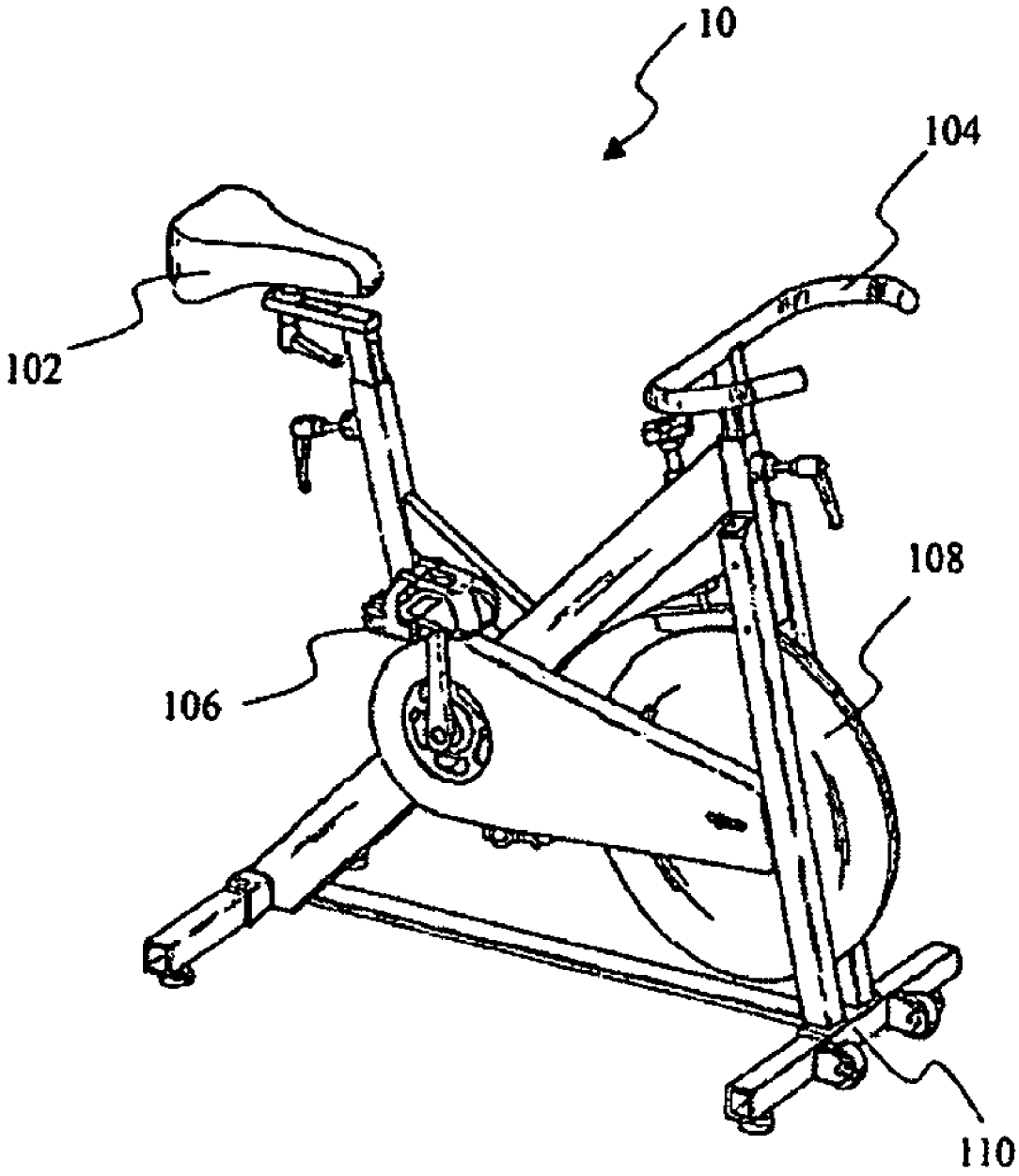
Fig.1 (Prior Art)
FIG. 1 is a perspective structure diagram of an adjustable stationary exercise bicycle in the prior art.
Figure 2:
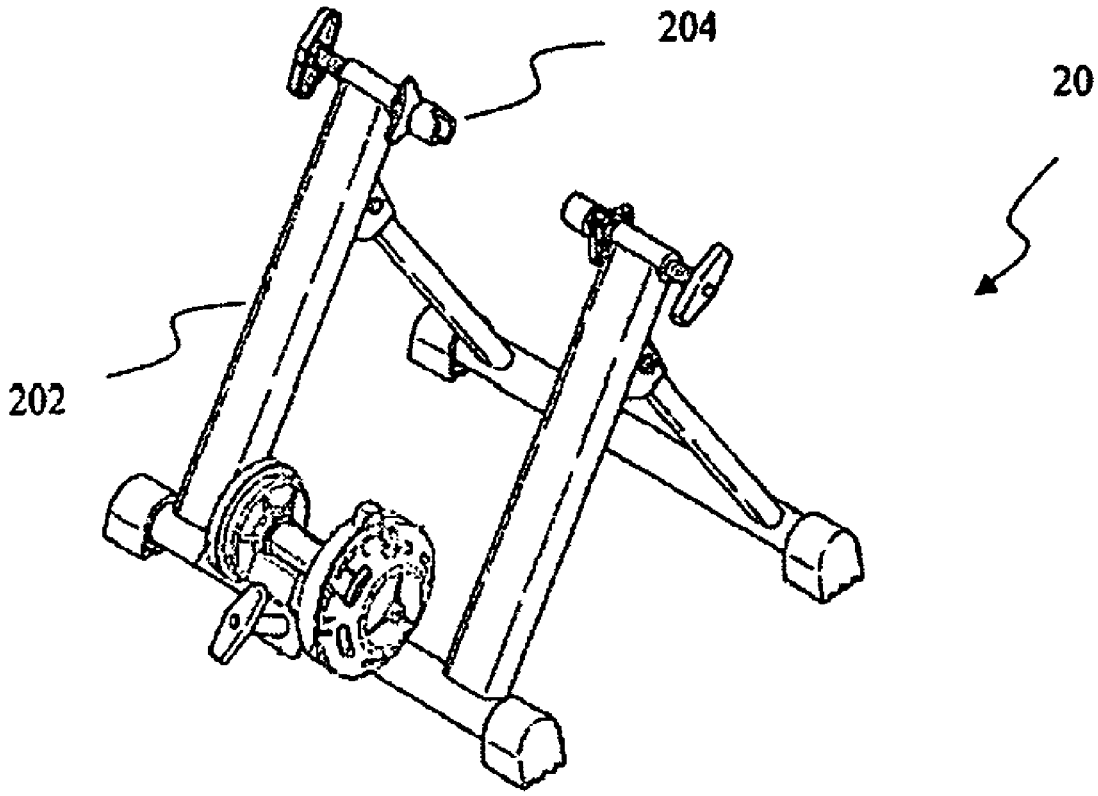
Fig.2 (Prior Art)
FIG. 2 is a perspective structure diagram of a stationary bicycle resistance generator in the prior art.
Figure 3:
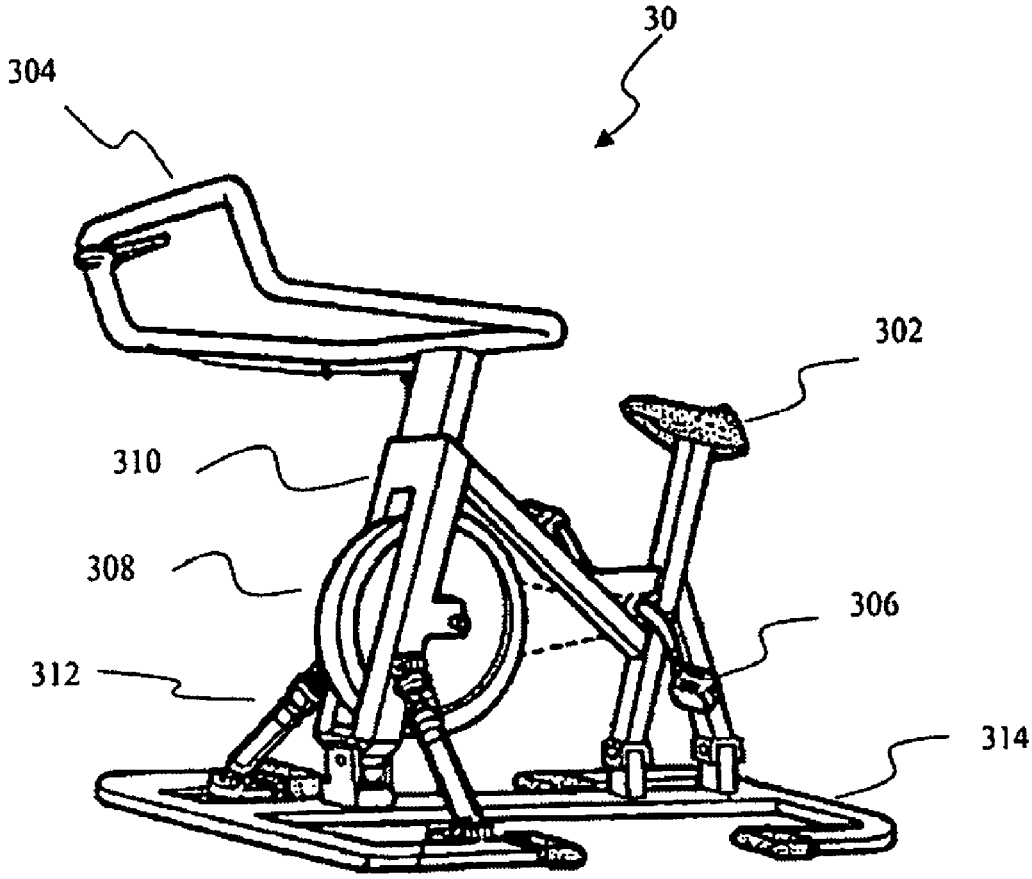
Fig.3 (Prior Art)
FIG. 3 is a perspective structure diagram of an exercise stationary bicycle in the prior art.
Figure 4:
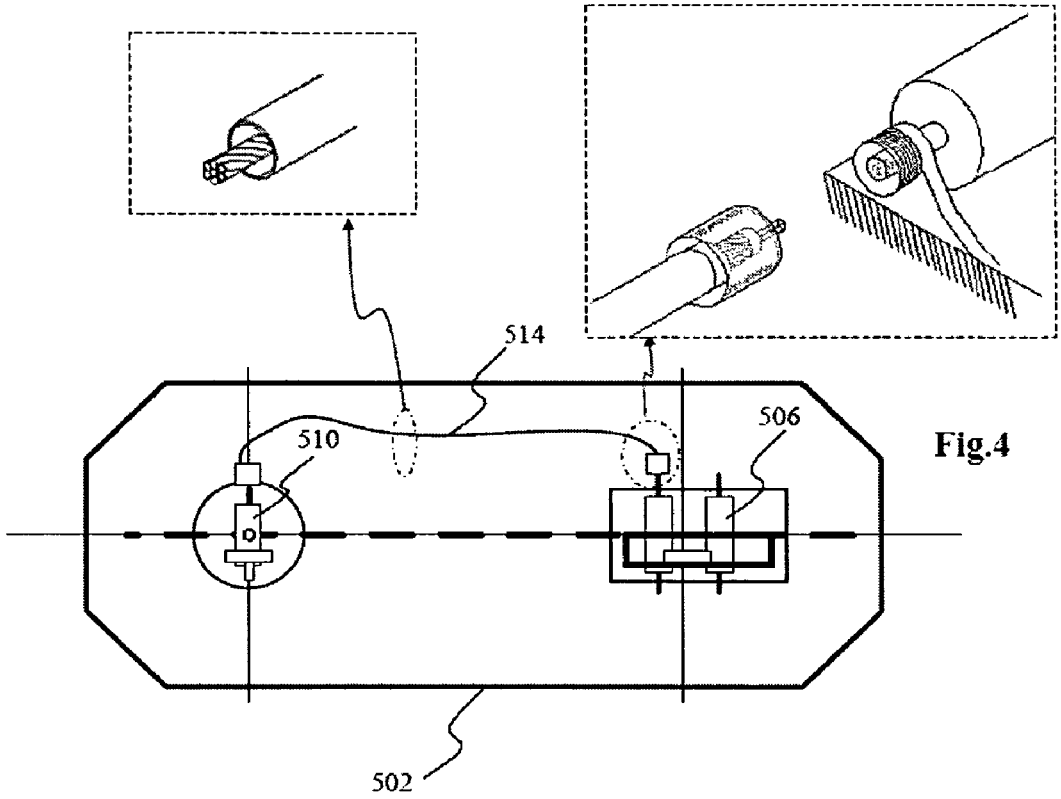
FIG. 4 is a top view of the present invention.
Figure 5:
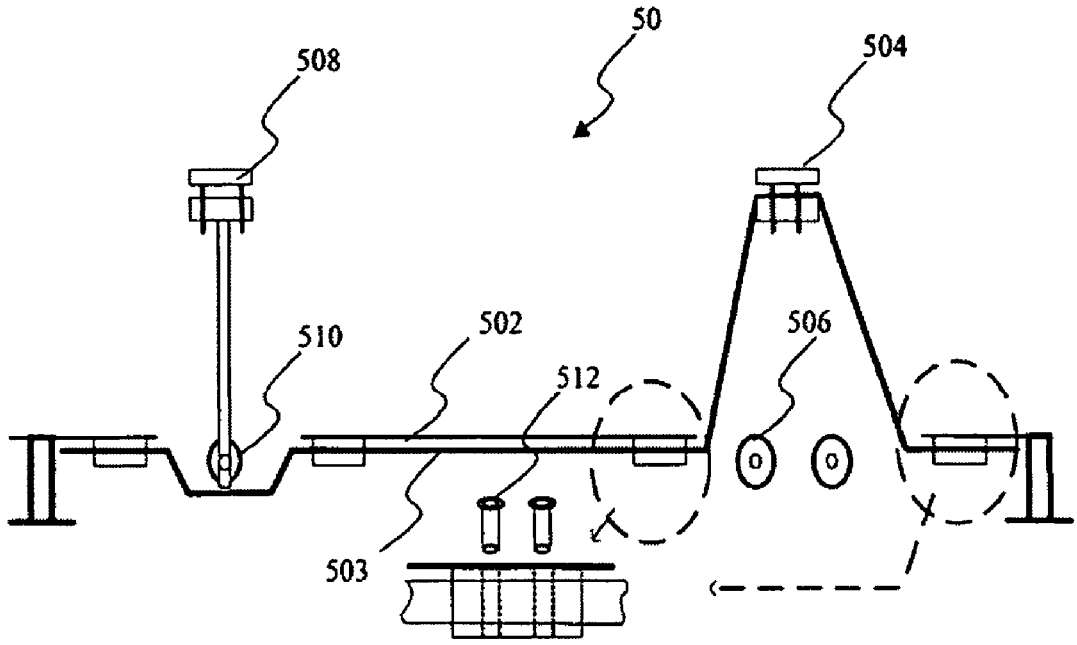
FIG. 5 is a side view of the present invention.
Figure 6:
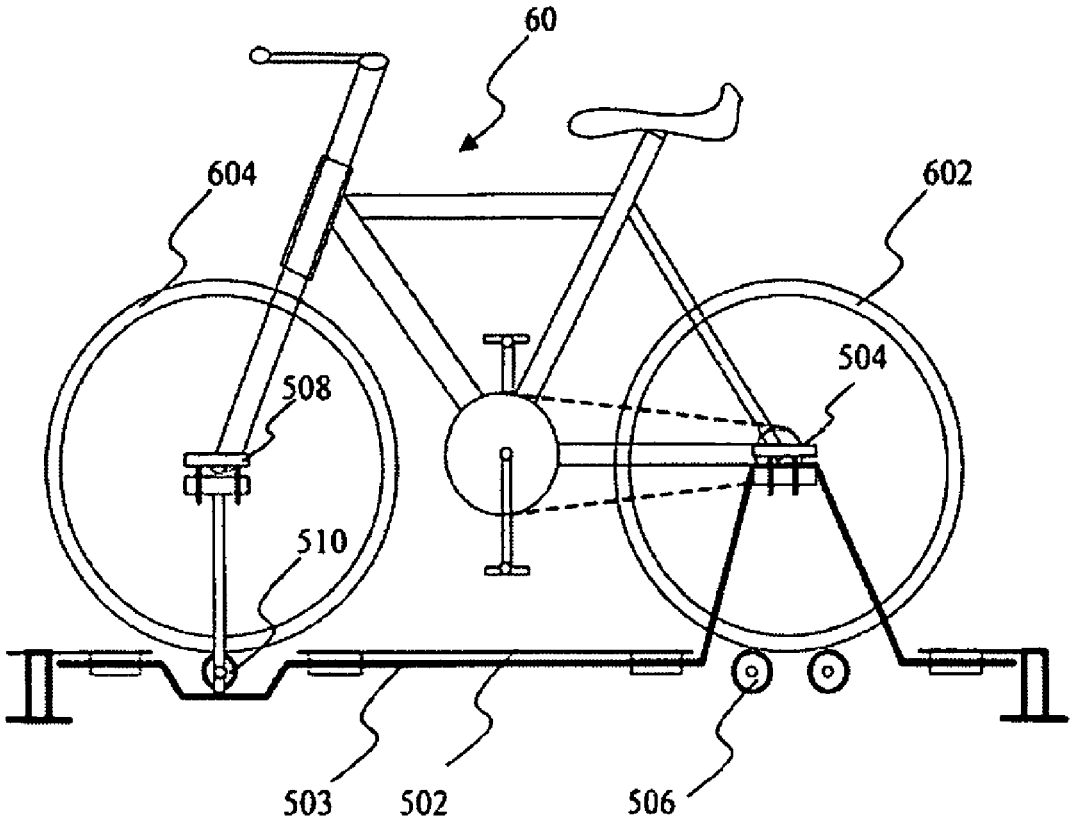
FIG. 6 is a side view according to an embodiment of the present invention.

In order to help people achieving the effect of exercise indoors, the present invention proposes an auxiliary supporting device of a bicycle. As shown in FIGS. 4, 5 and 6, an auxiliary supporting device 50 comprises a base 502 with a main rotating shaft 503. The main rotating shaft 503 has a protruding part 504, and a rear wheel 602 of a bicycle 60 is engaged on the protruding part 504. Two rolling elements 506 are disposed on the base 60 and located below the protruding part 504 such that rear wheel 602 of the bicycle 60 is located on the rolling elements 506. The main rotating shaft 503 has also a supporting element 508. The supporting element 508 includes a rotating element connected with a rolling element 510 for engaging a front wheel 604 of the bicycle 60 such that front wheel 604 is located on the rolling element 510.

Figure 7A:
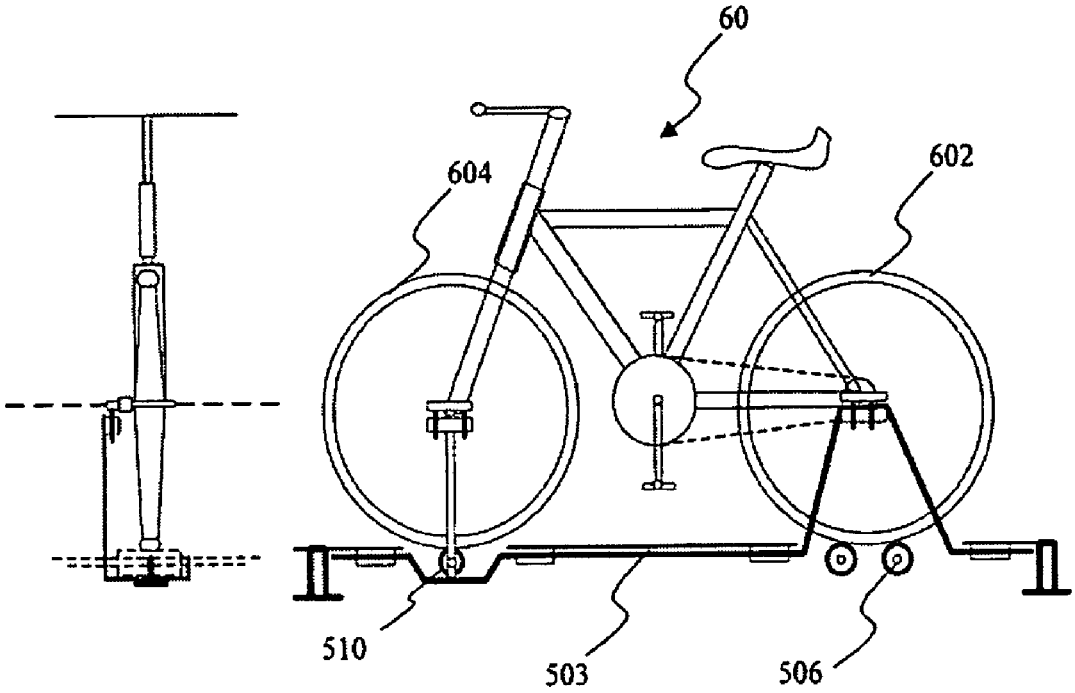
FIGS. 7(*a*) and 7(*b*) are diagrams showing a front view of supporting element and a bicycle sway on the present invention.
Figure 7B:
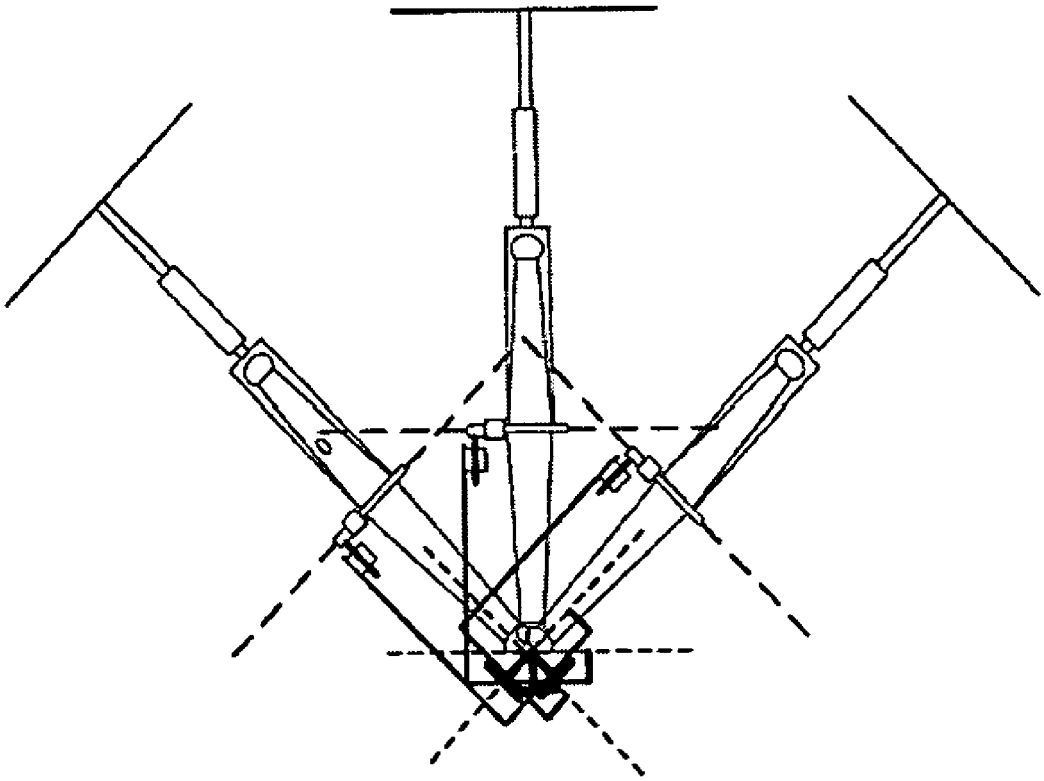

The main rotating shaft 503 can be either free rotated to let bicycle 60 sway (As shown in FIGS. 7(*a*) and 7(*b*), the bicycle 60 can swing along the axle of the main rotating shaft 503.) or fixed by a fixing element 512 like a tenon joint such that it cannot rotate. The fix element 512 can be applied in the cases: (1). When the bicycle 60 is not in use, the main rotating shaft 503 is fixed to prevent the bicycle 60 from falling down. (2).

It also can be used to train a user who cannot ride bicycle to move the pedals of the bicycle 60 without worrying bicycle 60 falls down.

In addition to the function of bicycle 60 swing along the axle of main rotating shaft 503, the supporting element 508 can also be engaged with the main rotating shaft 503 via a bearing 516 so as to rotate along the direction perpendicular to the main rotating shaft 503, thereby making the handlebars of the bicycle 60 be able to turn left and right.

Besides, the rolling element 510 is connected to the rolling elements 506 via a rotating guide wire 514. The rolling elements 506 and 510 are rollers. When a user moves the pedals of the bicycle 60, the rear wheel 602 leads the rolling elements 506 to roll and further drives the rotating element 510 to rotate through a rotating guide wire 514 so as to let the front wheel rotate therewith, thereby accomplishing synchronous rotation of the front and rear wheels.

Figure 8:
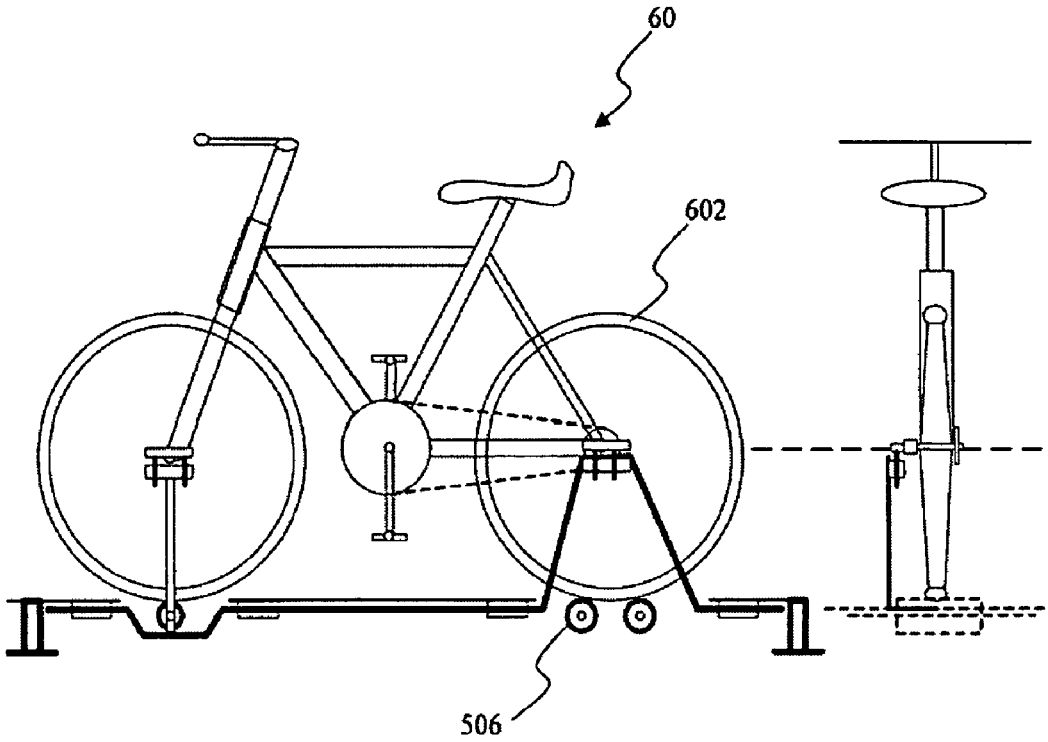
FIG. 8 is a diagram showing a back view of the present invention.
Figure 9:
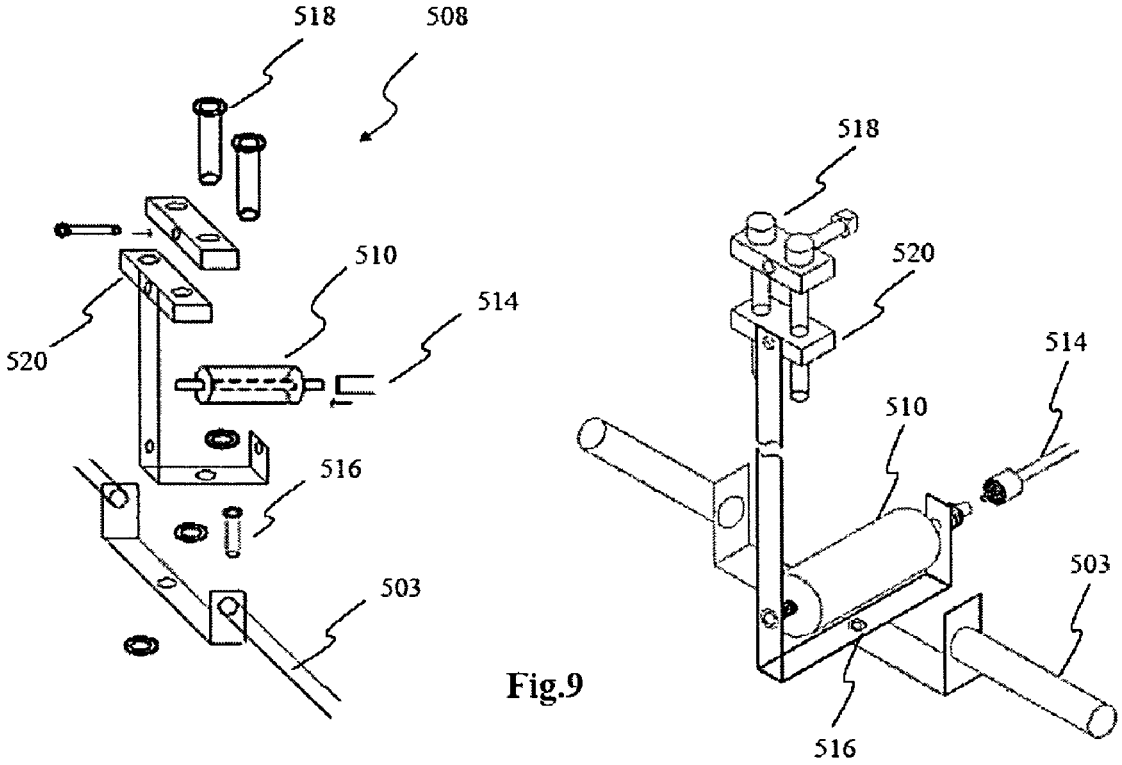
FIG. 9 is a perspective view of a supporting element, a rolling element, and a bearing of the present invention.

As shown in FIG. 8, the rear wheel 602 of the bicycle 60 is supported by the two rolling elements 506, and the engagement between the rear wheel of the bicycle 60 and the protruding part 504 is accomplished by means of piston and bushing (the engagement between the front wheel axle of the bicycle 60 and the supporting element 508 is also accomplished by means of piston 518 and bushing 520, as shown in FIG. 9) such that the weight of a rider and the bicycle 60 can be directly transmitted to the rolling elements 506. The rear wheel 602 of the bicycle 60 rotates to lead the rolling elements 506 to roll. The roughness degree of the surface of the rolling elements 506 makes the rider feel as though he is rides on the road.

To sum up, when a rider uses this auxiliary supporting device of a bicycle (with not fixed by a fixing element 512), the principle of the bicycle 60 won't fall down is the same as that of riding a bicycle on the road. They both exploit the moment of inertia generated through rotation of the front and rear wheels. The present invention utilizes the rotation of the rear wheel of the bicycle to lead the rolling elements to roll and further drives the front wheel to rotate via the rotating guide wire and front wheel rolling element. By this auxiliary supporting device of a bicycle, the bicycle can swing and the handlebars of the bicycle can turn left and right. Therefore, the user can simulate the exercise of riding bicycle at a fixed location.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An auxiliary supporting device for a bicycle, the auxiliary supporting device comprising:

(a) a base connected with a main rotating shaft having a protruding part for engaging a rear wheel of the bicycle; at least a rolling element located below said protruding part so that said rear wheel is located on said rolling element;

(b) a supporting element disposed above said main rotating shaft, being engaged with a front wheel of the bicycle, including a rotating element connected with a second rolling element so that said front wheel is located on the second rolling element whereby a user can simulate the exercise of riding said bicycle, including swaying said bicycle and turning a handlebar of the bicycle, at a fixed location.

2. The auxiliary supporting device for a bicycle as claimed in claim 1, wherein said main rotating shaft can be (a) either freely rotated to let said bicycle sway;

(b) or fixed by at least a fixing element to prevent said bicycle from swinging arbitrarily.

3. The auxiliary supporting device for a bicycle as claimed in claim 2, wherein said fixing element is a tenon joint.

4. The auxiliary supporting device for a bicycle as claimed in claim 1, wherein both rolling elements are rollers.

5. The auxiliary supporting device for a bicycle as claimed in claim 1, wherein said supporting element is engaged with said main rotating shaft by a bearing to allow a handlebar of a bicycle engaged with the auxiliary supporting device to turn right and left during exercise.

* * * * *